US006522848B2

(12) United States Patent
Wakana

(10) Patent No.: US 6,522,848 B2
(45) Date of Patent: Feb. 18, 2003

(54) BELT UNIT AND APPARATUS TO WHICH BELT UNIT IS ATTACHED

(75) Inventor: Takashi Wakana, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/931,478

(22) Filed: Aug. 16, 2001

(65) Prior Publication Data

US 2002/0021916 A1 Feb. 21, 2002

(30) Foreign Application Priority Data

Aug. 21, 2000 (JP) ..... 2000-249550

(51) Int. Cl.[7] ..... G03G 15/16; G03G 15/00; B65H 5/02

(52) U.S. Cl. ..... 399/121; 399/110; 399/116

(58) Field of Search ..... 399/110, 121, 399/116, 162, 107, 122, 303; 347/138, 152

(56) References Cited

U.S. PATENT DOCUMENTS 5,243,384 A * 9/1993 Everdyke et al. ..... 399/116
5,400,121 A * 3/1995 Foote ..... 399/116
5,669,054 A * 9/1997 Uchida et al. ..... 399/121 X
5,819,139 A * 10/1998 Harlan et al. ..... 399/110
RE37,157 E * 5/2001 Ikeda et al. ..... 399/116 X
2001/0028812 A1 * 10/2001 Saitoh et al. ..... 399/116

FOREIGN PATENT DOCUMENTS

JP 2000-194203 * 7/2000

* cited by examiner

*Primary Examiner*—Sophia S. Chen
(74) *Attorney, Agent, or Firm*—Akin, Gump, Strauss, Hauer & Feld, L.L.P.

(57) ABSTRACT

A belt unit is attached to an apparatus. The belt unit includes a drive roller and an idle roller about which a belt is entrained and runs, and a first bearing fitted to a shaft about which the drive roller rotates. The apparatus includes a cutout that receives the first bearing, and a locking member that engages the bearing to firmly hold the first bearing in position. A line passing through the centers of the first and second gears makes an angle with a vertical line passing through the center of the first gear, the angle being larger than a pressure angle between the first gear and the second gear. The apparatus has a groove that extends in a direction parallel to the direction of travel of the belt and receives the bearing of the idle roller.

10 Claims, 13 Drawing Sheets

BELT UNIT AND APPARATUS TO WHICH BELT UNIT IS ATTACHED

BACK GROUND OF THE INVENTION

1. Field of the Invention

The present invention relates to a belt unit and an apparatus to which a belt unit is attached.

2. Description of the Related Art

A conventional electrophotographic printer Incorporates a transfer belt unit therein.

FIG. 18 illustrates one such conventional transfer belt unit incorporated in a conventional electrophotographic printer.

Referring to FIG. 18, a transfer belt unit (referred to as belt unit hereafter) 3 is placed in position by positioning the belt case 8 with respect to an electrophotographic printer (referred to as printer hereafter) 1. The belt unit 3 includes primarily a transfer belt 4, a drive roller 5, an idle roller 6, a transfer roller, not shown, and a cleaning blade, not shown. The transfer belt 4 is an endless loop and is entrained about the drive roller 5 and the idle roller 6. The transfer belt 4 has a width greater than a maximum width of paper that is accepted by the printer 1.

The drive roller 5 has a surface formed of a highly frictional material and rotates about a shaft, not shown. The shaft has a gear, not shown, which is in mesh engagement with a drive gear not shown, provided on the printer side, so that a drive force is transmitted through the gears. When the drive roller 5 is driven in rotation, the transfer belt 4 runs. The idle roller 6 maintains moderate tension in the transfer belt 4 so that the transfer belt 4 runs smoothly. The shafts of the drive roller 5 and idle roller 6 are supported on a belt frame not shown, assembled on the belt case 8.

If the belt unit 3 is a user-replaceable component of the printer, the belt case 8 is formed with grooves therein, not shown, which ride on guide rails 9 provided in the printer 1. When the belt unit 3 is taken out of the printer 1 for maintenance or attached to the printer 1 after maintenance, the side frame 2 pivotally mounted to the printer 1 is opened and then the belt unit 3 is drawn out of or pushed Into the printer 1. After the belt unit 3 has been completely inserted into the printer 1, the belt unit 3 is finally locked with connections of the belt case S fitting to their counter parts on the printer 1.

The belt unit 3 may be attached to and detached from the printer 1 from the front side of the printer 1.

The side frame 2 is first opened and then the belt unit 3 is attached to or detached from the front side or lateral side of the printer 1. Thus, the aforementioned conventional belt unit 3 suffers from the problem that the printer 1 requires a larger floor space than it actually takes up.

The belt case 8 is directly positioned relative to the printer 1, so that the transfer belt 4 is indirectly placed in position in the printer 1. If the belt unit 3 is skewed so that the drive roller 5 and idle roller 6 are not accurately positioned in the printer 1, then the drive roller 5 and idle roller 6 are no longer parallel to each other, causing the transfer belt 4 to become somewhat twisted. As a result, the transfer belt 4 vibrates while rotating.

The belt case 8 is positioned with respect to the printer 1, thereby positioning the gear attached on the shaft of the drive roller 5 relative to the drive gear on the printer side. This indirect positioning of the two gears may cause the gears to mesh with poor accuracy, resulting in non-uniformity of the running speed of the transfer belt 4.

SUMMARY OF THE INVENTION

The present Invention was made in view of the aforementioned drawbacks of the conventional apparatus.

A belt unit includes at least two rollers mounted on a frame; a belt entrained about the at least two rollers and driven to run with a medium placed thereon; and a carrying handle that generally extends in a direction substantially perpendicular to a direction in which the belt runs. The carrying handle is pivotally attached to the frame.

When the carrying handle is left free to pivot, the carrying handle pivots toward the belt unit, the frame has a stopper provided thereon, the stopper abuts a part of the carrying handle to prevent the carrying handle from pivoting any further when the carrying handle is left free to pivot.

The carrying handle may be secured to the belt unit at a position off the center of gravity of the belt unit.

The belt unit includes a drive roller and an idle roller about which a belt is entrained and runs when the drive roller rotates, and a first bearing fitted to a longitudinal end of a shaft about which the drive roller rotates.

The apparatus includes a bearing-receiving portion and a locking member. The bearing-receiving portion receives the first bearing when the belt unit Is attached to the apparatus. The locking meter engages the bearing to firmly hold the first bearing in position when the first bearing is received in the bearing-receiving portion.

The belt unit includes a first gear attached to a shaft of the drive roller. The apparatus includes a second gear that moves into meshing engagement with the first gear when the belt unit is attached to the apparatus. The first gear and the second gear are positioned so that a line passing through a first center of the first gear and a second center of the second gear makes an angle with a vertical line passing through the first center, the angle being larger than a pressure angle between the first gear arid the second gear.

The belt unit further includes a second bearing attached to a shaft of the idle roller. The apparatus further includes a frame formed with a groove that receives the second bearing when the belt unit is attached to the apparatus. The groove has a portion that extends in a direction substantially parallel to the direction in which the belt runs, and in which the first bearing is slidable.

The frame has an inclined surface that upwardly extends from the bearing-receiving portion. When the belt unit is attached to the apparatus, the inclined surface guides the first bearing into the bearing-receiving portion.

The belt unit further includes a guide projection formed on the frame on a side of the idle roller remote from the drive roller. The apparatus further includes a vertical groove formed therein that extends in a direction substantially perpendicular to the direction in which the belt runs. The vertical groove guides the guide projection when the belt unit is attached to the apparatus.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not-limiting the present invention, and wherein.

DETAILED DESCRIPTION OF THE INVENTION

Embodiments of the invention will be described in detail with reference to the accompanying drawings.

First Embodiment (Construction)

Figure 1A:
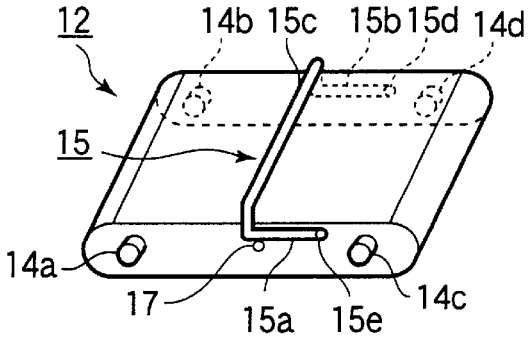
FIG. 1A is a general perspective view of a transfer belt unit according to a first embodiment.

FIG. 1A is a general perspective view of a transfer belt unit according to a first embodiment.

Figure 2:
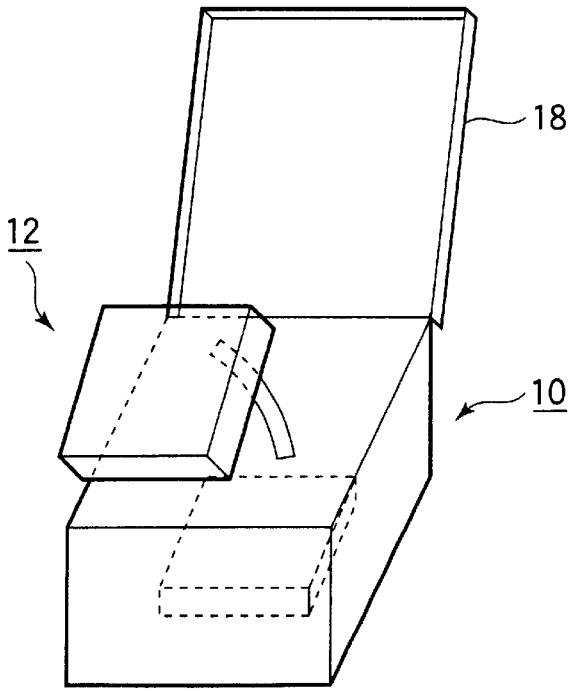
FIG. 2 is a general perspective view of the first embodiment, illustrating the transfer belt unit according to the first embodiment and the electrophotographic printer.

FIG. 2 is a general perspective view, illustrating the transfer belt unit and an electrophotographic printer.

Referring to FIG. 1A, a belt frame 23 has locking projections 14*a*–14*d* that project outwardly from the opposing side walls of the belt frame 23. When the belt unit 12 is attached to the printer 10, the locking projections 14*a*–14*d* fit their corresponding locking mechanisms, not shown, formed on the printer 10, thereby placing the belt unit 12 in position.

A generally U-shaped carrying handle 15 includes a grip 15*c* arid short bars 15*a* and 15*b*. The grip 15*c* extends across the belt frame 23 in a direction transverse to a direction in which a transfer belt runs. The short bars 15*a* and 15*b* extend in directions substantially perpendicular to the grip 15*c* and are pivotally mounted at their free ends 15*e* and 15*d* to the opposing side walls of the belt frame 23. The carrying handle 15 has its center of gravity away from the free ends 15*e* and 15*d* of the short bars 15*a* and 25*b*. When the carrying handle 15 is left free to pivot, it pivots about the free ends 15*e* and 15*d* until the carrying handle 15 abuts stoppers 17 formed on the belt unit 12. When the carrying handle 15 abuts stoppers 17 provided at both sides of the belt frame 23, the grip 15S*c* is still over the transfer belt 11 and does not contact the paper that is transported on the transfer belt 11.

Figure 1B:
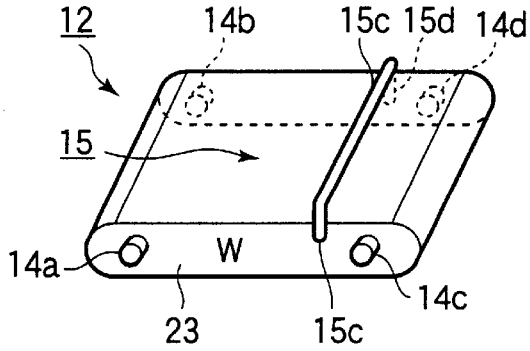
FIG. 1B is a general perspective view of a modification of the transfer belt unit of FIG. 1A.

Referring to FIGS. 1A and 1B and 2, an electrophotographic printer 10 (referred to as printer 10 hereafter) incorporates a transfer belt unit 12 (referred to as belt unit hereafter) that incorporates a transfer belt of an endless loop having a width larger than a maximum width of print paper. The belt unit 12 includes primarily the belt frame 23 shown in FIG. 15, a transfer belt 11, various rollers such as an idle roller 34, a drive roller 20 about which the transfer belt 11 is entrained, and a transfer roller, not shown, and a cleaning blade. The idle roller 34 is urged by a spring in a direction away from the drive roller 20, so that the idle roller 34 maintains moderate tension in the transfer belt 11. Because the length of the transfer belt 11 varies within a certain tolerance, the center-to-center distance between the idle roller 34 and drive roller 20 varies within a certain tolerance. The electrophotographic printer 10 has a lid 18 that is opened vertically as shown in FIG. 2 when the belt unit 12 is replaced or an ID unit 16 (FIG. 4) is replaced.

Figure 3:
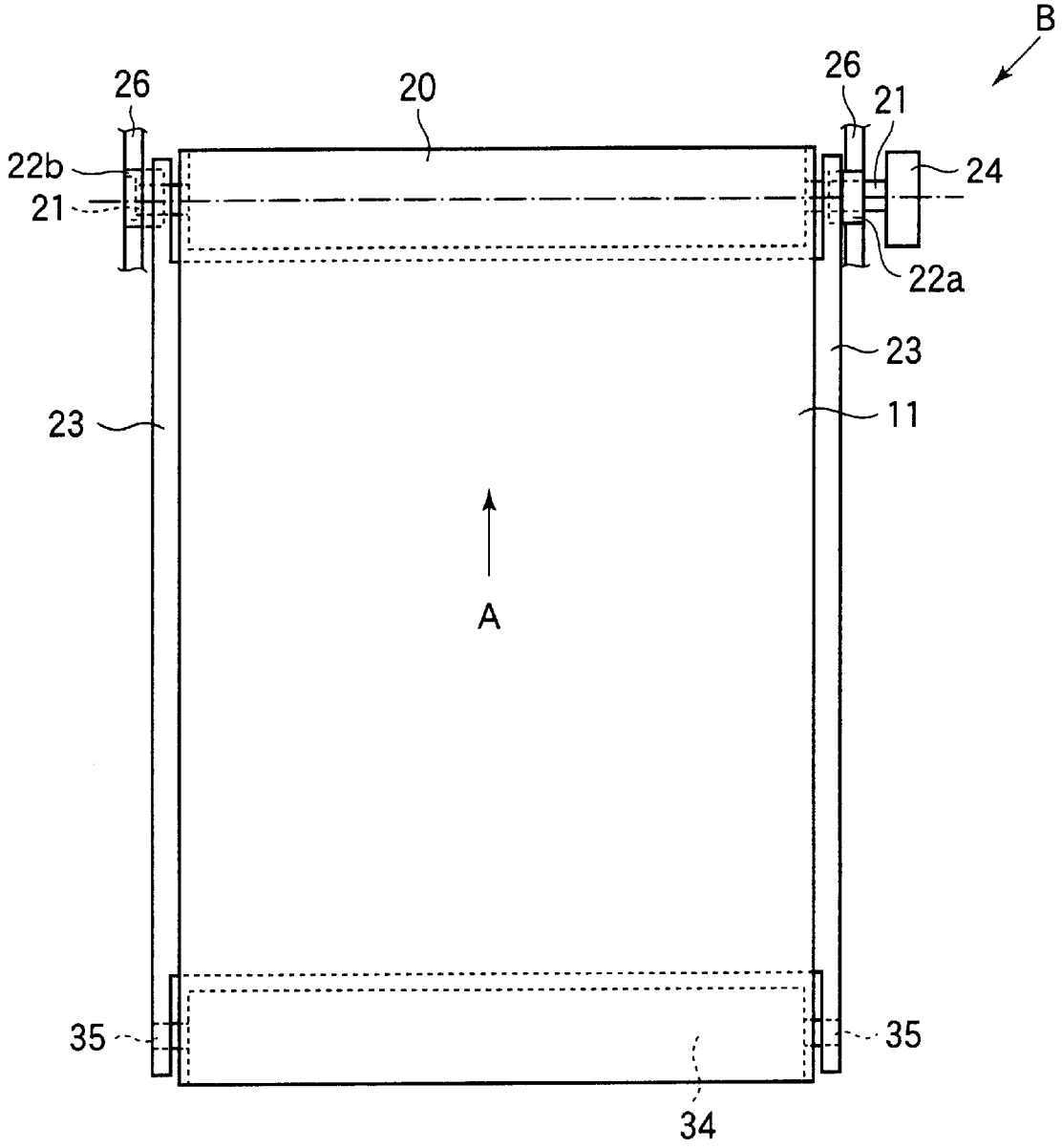
FIG. 3 is a general top view illustrating the transfer belt unit according to the first embodiment.

FIG. 3 is a general top view illustrating the transfer belt unit, according to the first embodiment.

The drive roller 20 has a surface formed of a highly frictional material and rotates about a shaft 21. The shaft 21 has a drive gear 24 mounted thereto. When the belt unit 12 has been attached to the printer 10, the drive gear 24 is in meshing engagement with a reduction gear 29 (FIG. 7) provided on the printer side. Thus, a drive force is transmitted from the reduction gear 29 to the drive gear 24. The reduction gear 29 is a smaller gear of a dual gear having two spur gears of different diameters, not shown. The larger gear is driven by another small pinion gear, not shown, connected to a drive source. Thus, the reduction gear 29 reduces the speed of a drive source. When the drive roller 20 is driven in rotation, the transfer belt 11 runs in a direction shown by arrow A. The idle roller 34 maintains moderate tension in the transfer belt 11 so that the transfer belt 11 runs smoothly. The shaft 21 of the drive roller 20, the shaft 35 of the idle roller 34, and others are supported on a belt frame 23 by which the belt unit 12 is placed in position with respect to the printer 10.

Figure 4:
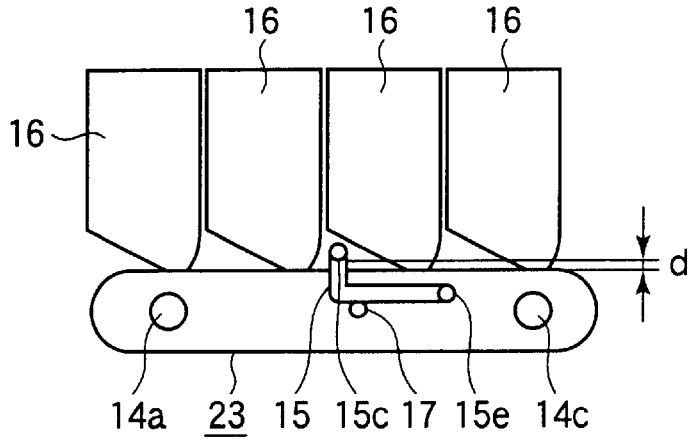
FIG. 4 is a side view illustrating the transfer belt unit according to the first embodiment and the image drum (ID) units.

FIG. 4 is a side view illustrating the transfer belt unit according to the first embodiment and the ID (image drum) units.

The belt unit 12 is attached to the printer 10 with the carrying handle 15 abutting the stoppers 17. As shown in FIG. 4, the carrying handle 15 takes up a position such that the grip 15*c* is between adjacent ID units 16 and is spaced a distance d away from the transfer belt. Therefore, the carrying handle 15 does not interfere with the ID units 16 as well as not interfering with the print paper, not shown.

Figure 5:
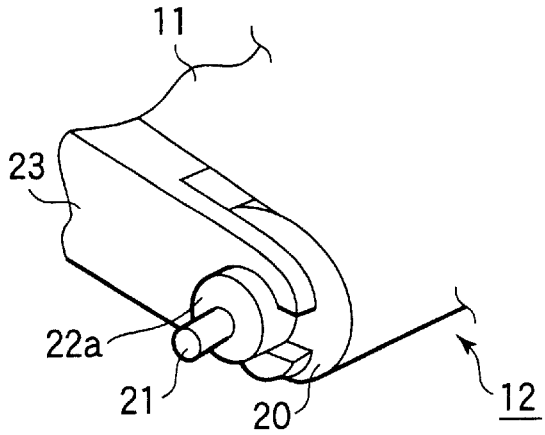
FIG. 5 is a fragmentary perspective view illustrating a bearing, a frame, and a drive roller of the first embodiment.

FIG. 5 is a fragmentary perspective view illustrating the bearing, belt frame 23, and drive roller 20 of the first embodiment when seen in a direction of arrow B of FIG. 3.

A bearing 22*a* is journaled to the shaft 21 on which the drive roller 20 rotates. The bearing 22*a* is supported in such a way that a part of the outer race of the bearing 22*a* is secured to the belt frame 23 and the rest of the outer race projects outwardly from the belt frame 23. Another bearing 22*b* is provided on the other end of the drive roller 20, but FIG. 5 show's only the bearing 22*a*.

Figure 6:
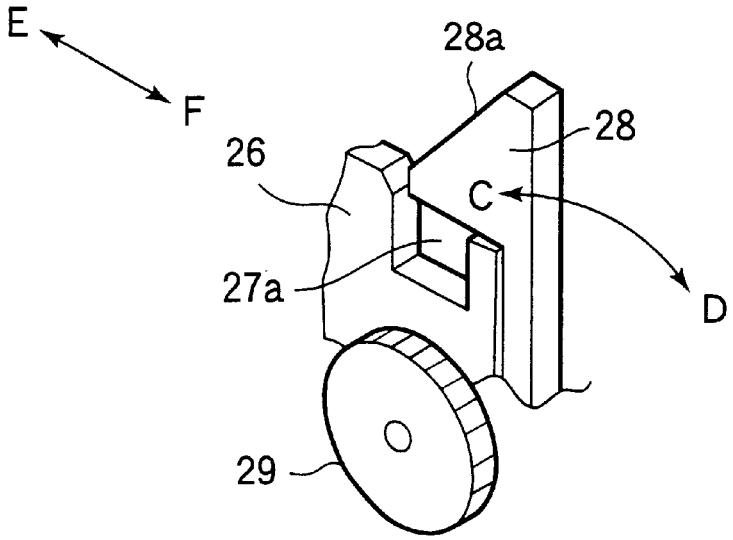
FIG. 6 is a fragmentary perspective view illustrating a cutout formed in the frame on the printer side and a locking member.

FIG. 6 is a fragmentary perspective view illustrating a cutout formed in a frame on the printer side and a locking member when seen in a direction of arrow B of FIG. 3.

The printer 10 has a frame 26 having two opposing sides between which the belt unit 12 is placed. Each side of the frame 26 has a U-shaped cutout 27*a* (only 27*a* is shown in FIG. 6) formed therein. A locking member 28 is mounted to the frame 26 so that the locking members 28 are pivotal in directions shown by arrows C and D and is urged in the C direction by springs, not shown. Another locking member is provided near the other end of the drive roller 20, but not shown.

Figure 7:
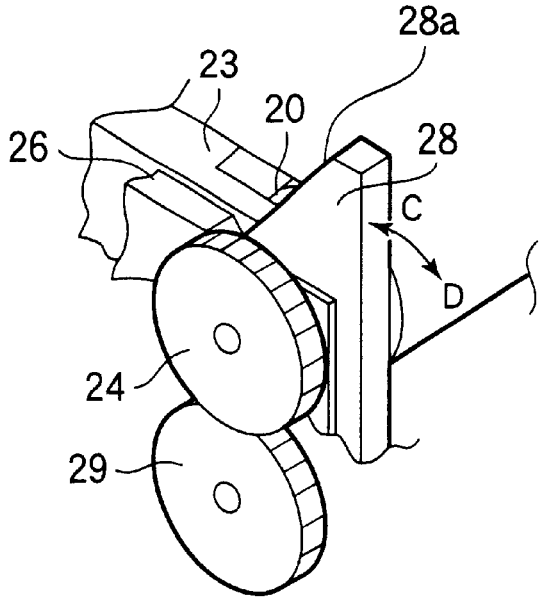
FIG. 7 is a fragmentary perspective view of the locking member, a drive gear, and a reduction gear when the bearing is received in the cutout.

FIG. 7 is a fragmentary perspective view of the locking member, drive gear, and reduction gear when the bearing is received in the cutout. FIG. 7 shows these elements when seen in a direction of arrow B of FIG. 3.

Referring to FIG. 7, when the belt unit 12 is attached to the printer 10, the cutout 27*a* receives a part of the bearing 22*a* that projects outwardly from the belt frame 23. Thus, the cutout 27*a* prevents the bearing 22*a* from moving in directions shown by arrows E and F (FIG. 6). When the locking member 28 is allowed to pivot in the direction shown by arrow C, it holds down the bearings 22*a* firmly. When the bearing 22*a* is fixed in the cutout 27*a*, the drive gear 24 is in mesh with the reduction gear 29 that is provided on the printer side and drives the drive gear 24 in rotation.

(Operation)

The operations in which the belt unit 12 of the aforementioned construction is attached to and detached from the printer 10 will be described.

(Detaching the Belt Unit from the Printer)

First, the operation for detaching the belt unit 12 from the printer 10 will be described.

Figure 8A:
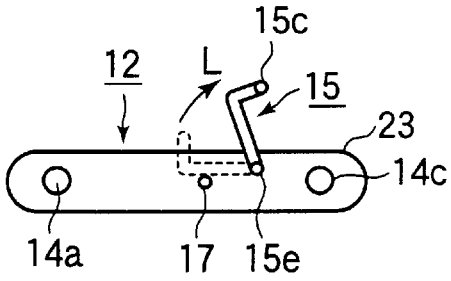
FIGS. 8A and 8B are side views of the belt unit illustrating the movement of the carrying handle.
Figure 8B:
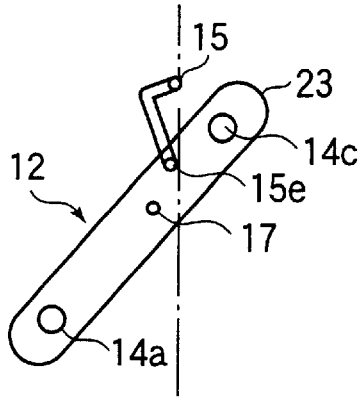

FIGS. 8A and 8B are side views of the belt unit 12 illustrating the movement of the carrying handle 15.

When the belt unit 12 has been attached to the printer 10, the carrying handle 15 is at a position as shown in FIG. 4 where the carrying handle 1*i* is clear of the ID unit 16 and does not interfere with the travel of the print paper. An operator holds the grip 15*c* of the carrying handle 15 and lifts the carrying handle 15 in a direction shown by arrow L as shown in FIGS. 8A and 8B. The carrying handle 15 pivots about the free ends 15*e* and 15*d* relative to the belt unit 12 until the grip 15*c* is farthest from the belt surface.

At this moment the operator grips the grip 15*c* by one hand and can lift it easily.

When the operator lifts the grip 15*c*, the locking projections 14*a*–14*d* move out of locking engagement with the locking mechanism, not shown, of the printer 10. Because the free ends 15*e* and 15*d* of the carrying handle 15 are located to the right hand side of the center of the belt unit 12, the belt unit 12 is inclined so that the left end of the belt unit 12 is lower than the right end. The inclination of the belt unit 12 is advantageous in that the belt unit 12 can be detached easily.

When the belt unit 12 is detached from the printer 10, the belt unit 12 is lifted upward so that the bearing 22*a* moves upward. The operator causes the locking member 28 to pivot in the direction shown by arrow D of FIG. 7 against the urging force of the spring.

(Attaching the Belt Unit to the Printer)

Now, the operation for attaching the belt unit 12 to the printer 10 will be described.

The operator holds the grip 15*c* and then lifts the carrying handle 15. Then, the operator carries the belt unit 12 by the grip 15*c* into the printer 10. Because the free ends 15*e* and 15*d* are mounted to the right side with respect to the center of gravity W of the belt unit 12, the belt unit 12 inclines as shown in FIG. 8B so that the left end is lower than the right end. The belt unit 12 can be more easily attached to the printer 10 when the belt unit 12 is inclined than when the belt unit 12 is not inclined. Then, the locking members 14*a*–14*d* are fitted into the locking mechanism, not shown, on the printer side. Then, when the operator releases the grip 15*c* or leaves the handle 15 free to pivot, the grip 15*c* falls toward the transfer belt 11 until the carrying handle 15 abuts the stopper 17. Thus, the carrying handle 15 takes up the position as shown in FIG. 4 where the carrying handle 15 is in a small gap or space between the adjacent ID units 16, thereby allowing the print paper, not shown, to pass between the grip 15*c* and the transfer belt 11.

When the belt unit 12 is attached to the printer 10, the bearing 22*a* exerts a pressing force on an inclined surface 28*a* of the locking member 28 pushing the locking member 28 out of the way. Thus, the locking member 28 is pivoted in the direction shown by arrow D against the urging force of the spring, so that the bearing 22*a* is received in the cutout 27*a*. Once the bearing 22*a* has been received in the cutout 27*a*, the locking member 28 springs back in the direction shown by arrow C to limit the upward movement of the hearing 22*a* in this manner, the bearing 22*a* is placed in position in the printer 10.

Because the shaft 21 extends through the bearing 22*a*, the shaft 21 can be accurately positioned once the bearing 22*a* is placed in position. Thus, the drive gear 24 secured on the shaft 21 can be accurately positioned so that the drive gear 24 can mesh with the reduction gear 29 with good accuracy as shown in FIG. 7. This allows the belt unit 12 to be accurately positioned in the printer 10 so that the transfer belt 11 is maintained taut in a direction substantially perpendicular to the drive roller 20.

The operator can lift the belt unit 12 by holding the grip 15*c* with one hand. This makes it possible to attach the belt unit 12 to and detach the belt unit 12 from the printer 10 by moving the belt unit 12 vertically rather than moving horizontally from a lateral side or a front side of the printer 10. This construction eliminates a side door or a front door that was required in the conventional apparatus, thereby saving a floor space required for opening the door when the belt unit 12 is replaced.

In the conventional art, a belt frame is positioned so that a belt unit is indirectly positioned. Therefore, the dimensional errors of the belt frame cause errors in the meshing engagement of a gear attached to the drive roller and a reduction gear on the printer side. In contrast to this, the bearing 22*a* of the present embodiment is positioned accurately, thereby accurately positioning the drive gear 24, drive roller 20, and belt frame 23. Thus, once the belt unit 12 has been attached to the printer 10, the drive gear 24, drive roller 20, and belt frame 23 are positioned with sufficient accuracy, thereby improving the meshing engagement of the reduction gear 29 with the drive gear 24. This eliminates non-uniformity of the running speed of the transfer belt 11.

The handle 15 may be positioned and secured to the belt unit 12 such that the handle 15 is fixed at a position off the center of gravity W of the belt unit 12 as shown in FIG. 1B. The construction of the handle 15 is advantageous in that the user can hold the grip 15*c* at its midway point where the center of gravity in the direction of length of the grip 15*c* is located.

Second Embodiment

Figure 9:
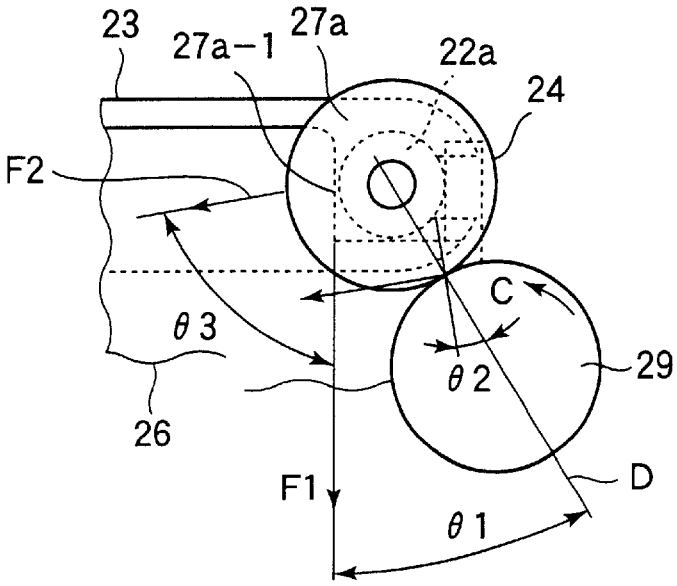
FIG. 9 is a side view of a belt unit according to a second embodiment, illustrating the positional relation between the belt unit and a part of an electrophotographlc printer.

FIG. 9 is a side view of a belt unit according to a second embodiment, illustrating the positional relation between the belt unit and a part of an electrophotographic printer.

The second embodiment is characterized in the positional relation between the drive gear 24 and the reduction gear 29 in mesh with the drive gear 24.

The side surface 27*a*-1 of the cutout 27*a* formed in the frame 26 makes an angle θ1 (about 20°) with a line M that passes through the center of the drive gear 24 and the center of the reduction gear 29. The reduction gear 29 is positioned relative to the drive gear 24 so that the angle θ1 is lager than the pressure angle θ2 between the gears 24 and 29 when the reduction gear 29 rotates in the direction shown by arrow L as shown in FIG. 9.

This angular relation between the gears 24 and 29 makes an angle 03 not larger than 90°, θ3 being the angle between a force F2 and the side surface 27*a*-1. In other words, the drive gear 24 receives a downward force F1, which is a component force of the force F2, so that the drive gear 24 is prevented from moving upward (i.e., in a direction in which the bearing 22*a* moves out of the cutout 27). Thus, the three sides defining the cutout 27*a* limit the movement of the bearing 22*a*.

The rest of the configuration and operation is the same as of the first embodiment and the description thereof is omitted.

The absence of an upward force exerted on the drive gear 24 eliminates the locking member 28 required in the first embodiment. This not only provides an easy detaching operation of the belt unit 12 easy but also reduces the manufacturing cost.

Third Embodiment

Figure 10:
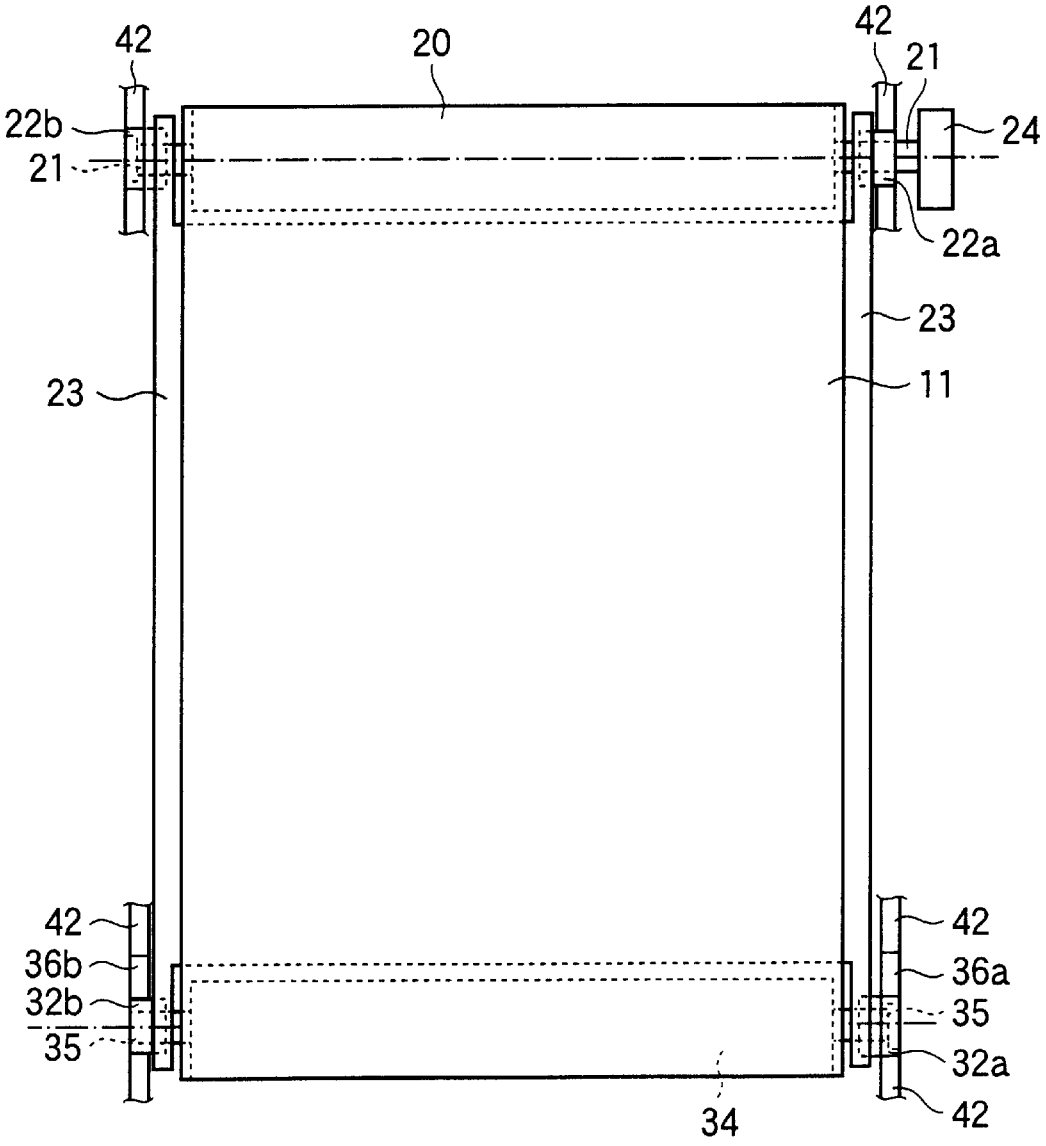
FIG. 10 is a general top view illustrating the transfer belt unit according to a third embodiment.

FIG. 10 is a general top view illustrating a transfer belt unit according to a third embodiment.

Figure 11:
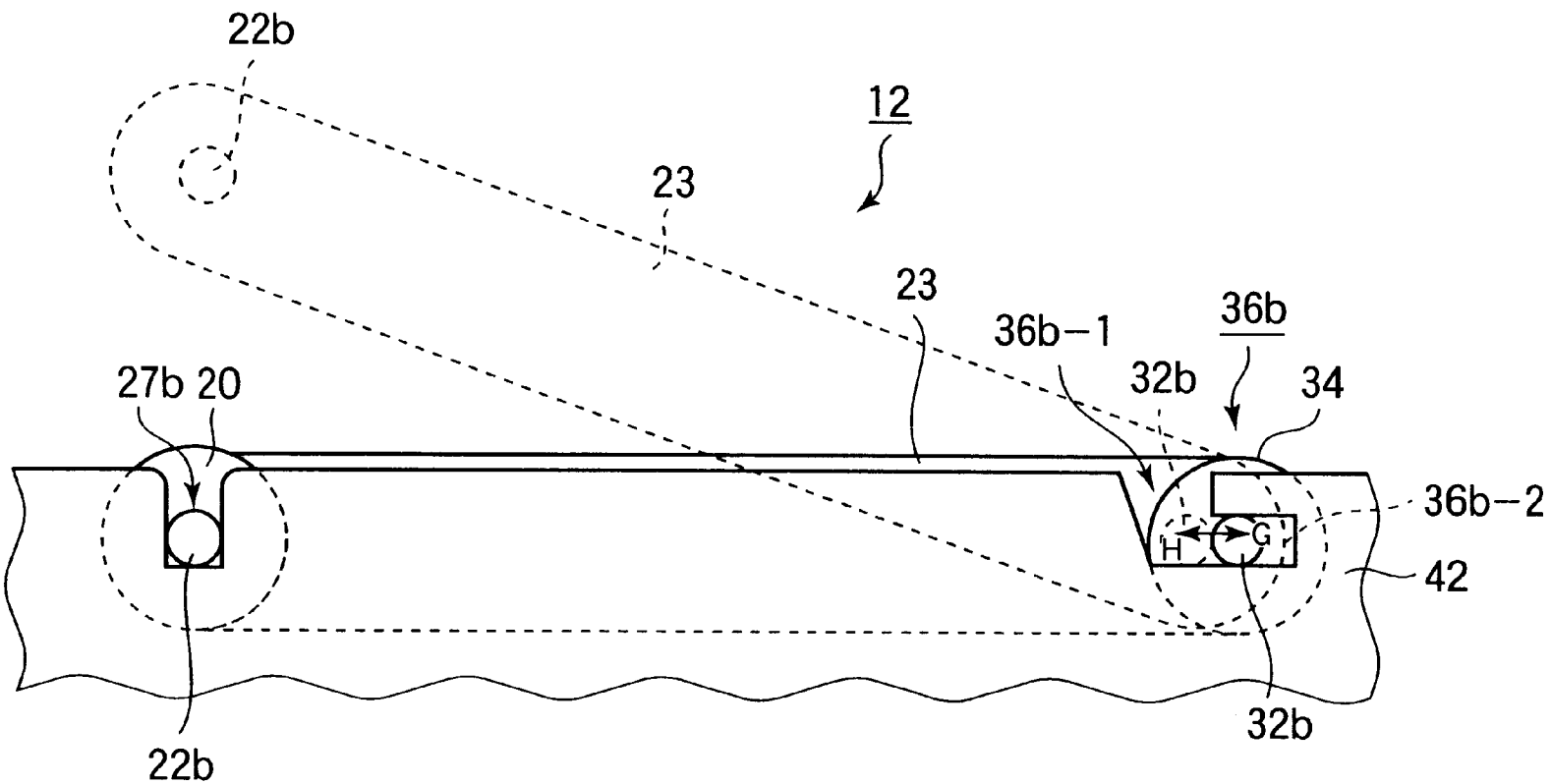
FIG. 11 is a side view of a transfer belt according to the third embodiment and an electrophoraphic printer.

FIG. 11 is a side view of the transfer belt according to the third embodiment and an electrophotographic printer.

The printer 10 has opposing frame 42 having two opposing sides between which the belt unit 12 supported. There are provided bearings 32*b* fitted to the shaft 35 of the idle roller 34 (FIG. 3), and L-shaped cutouts 36*b* formed in the frame 42 in the printer 10. The cutout 36*b* extends laterally in a direction in which the transfer belt 11 runs. The cutout 36*b* receives the bearing 32*b* therein. Another cutout and bearing are provided on the other side but only the bearing 32*b* and cutout 36*b* are shown in FIG. 11. Because the length of the transfer belt 11 varies within a certain tolerance, the center-to-center distance between the idle roller 34 and drive roller 20 varies within a certain tolerance range. A portion of the cutout 32*b* that extends in a direction parallel to the direction of travel of the transfer belt 11 effectively accommodates the variations in the center-to-center distance between the idle roller 34 and drive roller 20.

The bearing 32*b* is journaled to the shaft 35 on which the drive roller 20 rotates. The bearing 32*b* is supported in such a way that the outer race of the bearing 32*b* is partially secured to the belt frame 23 and projects outwardly of the belt frame 23. When the belt unit 12 has been attached to the printer 10, the bearing 32*b* is received in the cutout 36*b*. The bearing 22*b* is received in the cutout 27*b* that restricts the movement of the bearing 22*b* in the downward direction and lateral directions. The bearing 32*b* is received in the cutout 36*b* that prevents the bearing 32*b* from moving in vertical directions but allows the bearing 32*b* to move in horizontal directions in the cutout 36*b*.

The rest of the configuration of the third embodiment is the same as the first and second embodiments.

The operation in which the belt unit 12 of the aforementioned construction is attached to and detached from the printer 10 will be described.

(Attaching the Belt Unit to the Printer)

The operator holds the grip 15*c* and then lifts the carrying handle 15. Then, the operator carries the belt unit 12 into the printer 10. Because the free ends 15*e* and 15*d* are mounted to the right of the center of gravity W of the belt unit 12, the belt unit 12 inclines as shown in FIG. 8B such that the left end is lower than the right end. The belt unit 12 can be more easily attached to the printer 10 when the belt unit 12 is inclined than when the belt unit 12 is not inclined. Then, as shown in FIG. 11, the bearing 32*b* is inserted into an opening 36*b*-1 of the cutout 36*b*. The bearing 32*b* is then moved in a direction shown by arrow G along the bottom surface of the cutout 36*b*, from a dotted line position to a solid line position where the bearing 32*b* is fittingly positioned at the end of the cutout 36*b*. Then, the bearing 22*b* is inserted downward into the cutout 27*b* until the bearing 22*b* comes to rest. At this moment, the bearing 32*b* is movable laterally in a direction parallel to the direction in which the transfer belt 11 runs. Thus, the cutout 36*b* accommodates the slight positional change of the idle roller 34 with respect to the drive gear 24 due to the variations of length of the transfer belt 11, thereby maintaining a certain tension on the transfer belt 11. When the belt unit 12 is attached to the printer 10, the locking projections 14*a*–14*d* of the belt unit 12 also move into locking engagement with locking mechanisms, not shown, of the printer 10.

The rest of the operation is the same as that of the first and second embodiments.

(Detaching the Belt unit from the Printer)

The operation for detaching the belt unit 12 from the printer 10 will be described.

Just as in the first embodiment, the operator holds the grip 15*c* of the carrying handle 15 and lifts the carrying handle 15 in the direction shown by arrow L as shown in FIG. 8A. The carrying handle 15 pivots about the free ends 15*e* and 5*d* relative to the belt unit 12 until the grip 5*c* is farthest from the belt surface.

When the operator lifts the grip 15*c*, the locking projections 14*a*–44*d* of the belt unit 12 move out of locking engagement with the locking mechanism, not shown, of the printer 10. Lifting the grip 15*c* causes the bearing 22*b* to move upward to move out of the cutout 27*b*. Then, the operator moves the bearing 32*b* in a direction shown by arrow H (FIG. 11) and then lifts the grip 15*c*. Thus, the bearing 32*b* moves upward to move out of the cutout 36*b* so that the entire belt unit 12 is taken out of the printer 10.

The rest of the operation is the same as that of the first embodiment and the description thereof is omitted.

The structure of the third embodiment allows accurate positioning of the shaft 21 and shaft 35 relative to the printer 10. This accurate positioning prevents the twisting of the transfer belt 11 that is entrained about the drive roller 20 and the idle roller 34. Thus, the transfer belt 11 is prevented from vibrating while the transfer belt 11 is running.

When the belt unit 12 has been finally placed in position, the movement of the bearing 32*b* is restricted both vertically and horizontally. Therefore, the structure of the third embodiment eliminates the need for a locking mechanism such as one shown in FIGS. 6 and 7 for the bearing 32*b*, simplifying the structure as well as reducing the manufacturing cost.

Fourth Embodiment

Figure 12:
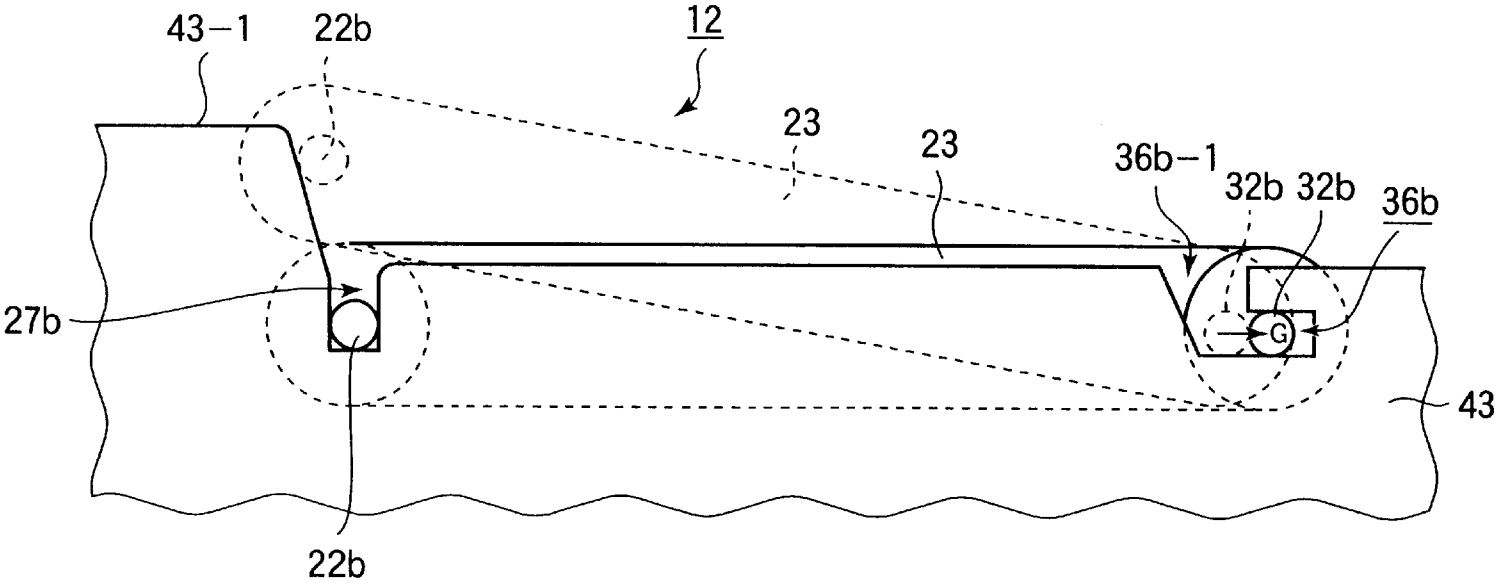
FIG. 12 is a side view illustrating a transfer belt unit according to a fourth embodiment and a portion of an electrophotographic printer.

FIG. 12 is a side view illustrating a transfer belt unit according to a fourth embodiment and a portion of an electrophotographic printer.

The fourth embodiment differs from the third embodiment in the shape of the frame. Specifically, there is provided a frame 43 having two opposing sides between which the belt unit 12 is supported. Each of the two frames 43 is formed with an upwardly extended inclined wall having a guide surface 43-1. The guide surface 43-1 extends upwardly from one of the walls that define the cutout 27*b*. Only the guide surface 43-1 and cutout 27*b* are shown in FIG. 12.

(Attaching the Belt Unit to the Printer)

The operation for attaching the belt unit 12 to the printer 10 will be described.

The operator holds the grip 15*c* (FIG. 1A) and then lifts the carrying handle 15. Then, the belt unit 12 inclines (FIG. 8B) such that the left end or the idle roller side is lower than the right end or drive roller side because the free ends 15*e* and 15*d* are mounted on the right of the center of gravity W of the belt unit 12. The belt unit 12 can be more easily attached to the printer 10 when the belt unit 12 is inclined than when the belt unit 12 is not inclined. The bearing 32*b* is first received into the opening 36*b*-1 of the cutout 36*b*. Then, the bearing 22*b* is brought into contact with the guide surface 43*a*. When the belt unit 12 is lowered, the bearing 22*b* is guided along the guide surface 43-1 into the cutout 27*b*, and the bearing 32*b* is guided in the cutout 36*b* in a direction shown by arrow G. When the bearing 22*b* is completely received into the cutout 27*b*, the bearing 22*b* and bearing 32*b* are accurately positioned in the printer 10. When the belt unit 12 has been attached to the printer 10, the locking members 14*a*–14*d* of the belt unit 12 are also fitted to the locking mechanism, not shown, of the printer 10.

The rest of the operation is the same as that of the third embodiment and the description thereof is omitted.

The belt unit 12 is detached from the printer 10 in the same manner as the third embodiment and therefore the description thereof is omitted.

The construction of the fourth embodiment makes it easy to attach the belt unit 12 to the printer 10.

Fifth Embodiment

Figure 13:
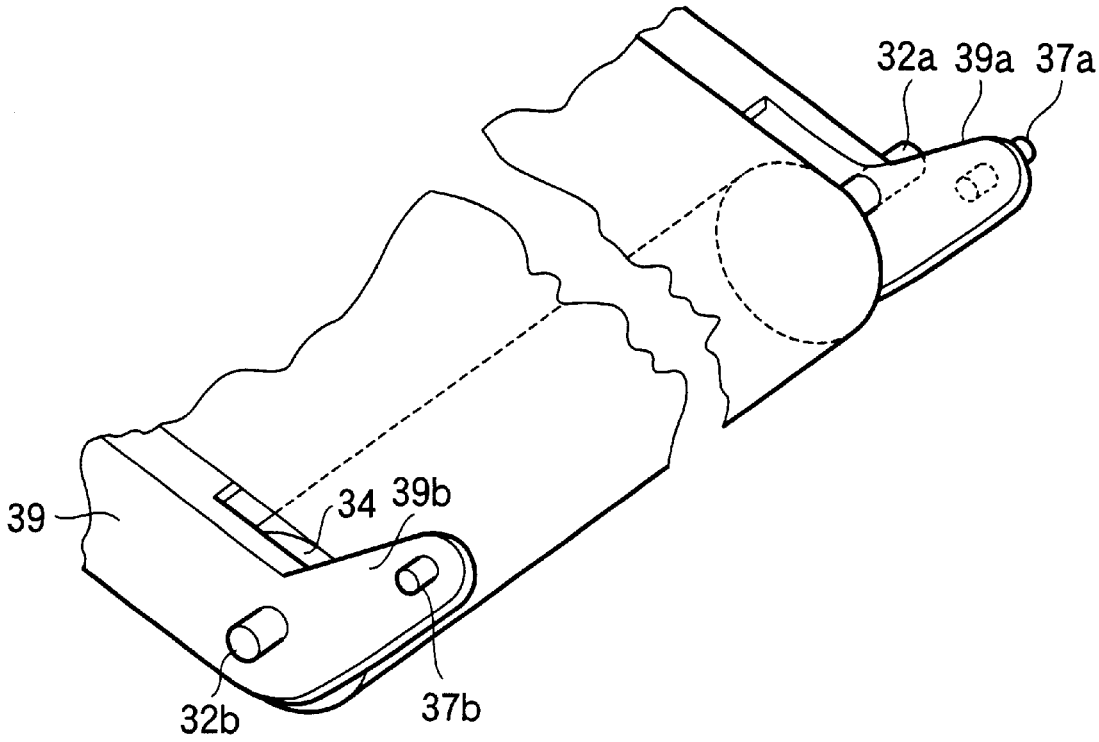
FIG. 13 is a fragmentary perspective view of the transfer belt unit according to a fifth embodiment.

FIG. 13 is a fragmentary perspective view of the transfer: belt unit according to a fifth embodiment.

Referring to FIG. 13, a projection 39*b* is on the side of the bearing 32*b* remote from the bearings 22*b*, extending somewhat upwardly at an angle with the direction in which the transfer belt 11 runs. The projection 39*b* has a projection 37*b* that outwardly laterally projects from the belt unit 12 and serves as a guide, which is described later. A projection 39*a* is on the side of the bearing 32*a* remote from the bearings 22*a*, extending somewhat upwardly at an angle with the direction in which the transfer belt runs. The projection 39*a* has a projection 37*a* that outwardly laterally projects from the belt unit 12 and serves as a guide.

Figure 14:
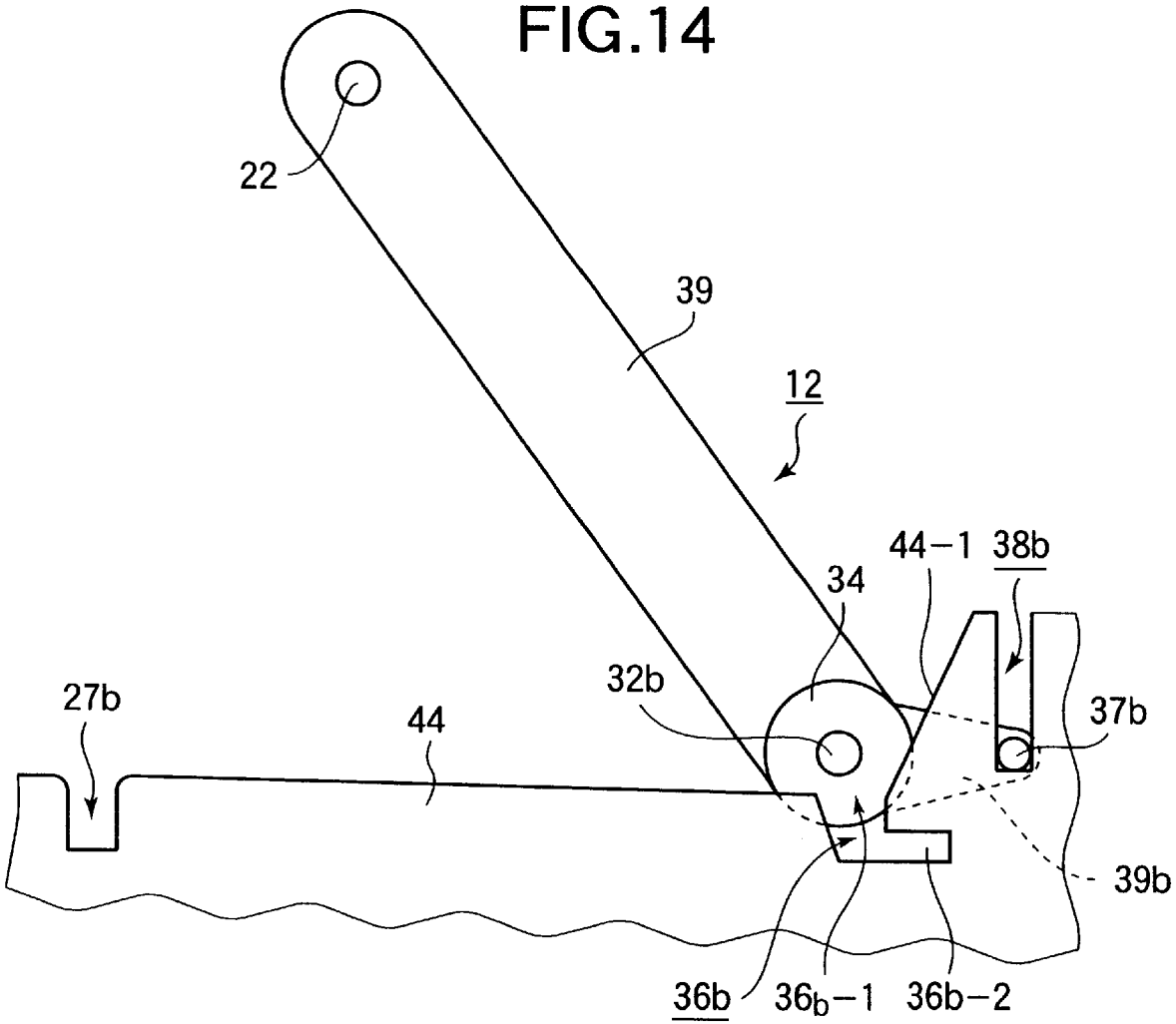
FIG. 14 is a side view of a transfer belt unit according to the fifth embodiment illustrating a portion of an electrophotographic printer.

FIG. 14 is a side view illustrating a transfer belt unit according to a fifth embodiment and a portion of an electrophotographic printer.

Referring to FIG. 14, just as in the third embodiment, the belt unit 12 has a bearing 32*b* fitted to the shaft 35 (FIG. 3) of the idle roller 34 and the printer 10 has a cutout 36*b* formed in the frame 44. There is provided frame 44 having two opposing sides between which the belt unit 12 is supported but only one side of the frame 44 is shown in FIG. 14. The cutout 36*b* receives the hearing 3Th therein. The cutout 36*b* includes opening 36*b*-1 and lateral grooves 36*b*-2. The frame 44 is formed with an upwardly opening guide-groove 38*b*. The openings 36*b*-1 is formed wide enough so that when the belt unit 12 is rotated about the projection 37*b* resting at the bottom of the guide groove 38*b*, the bearing 32*b* is not interfered by the walls that define the openings 36*b*-1. Another set of guide surface, guide groove, and cutout is provided on the other side but only the guide surface 44-1, guide groove 38*b*, and cutout 27*b* are shown in FIG. 14. A bearing 32*a* and a cutout 36*a* of the same configuration as the bearing 32*b* and cutout 36*b* are provided on the side of the frame 44, but only the bearing 32*b* and cutout 36*b* are shown in FIG. 14.

The operation for attaching the belt unit 12 to the printer 10 will be described.

Figure 15:
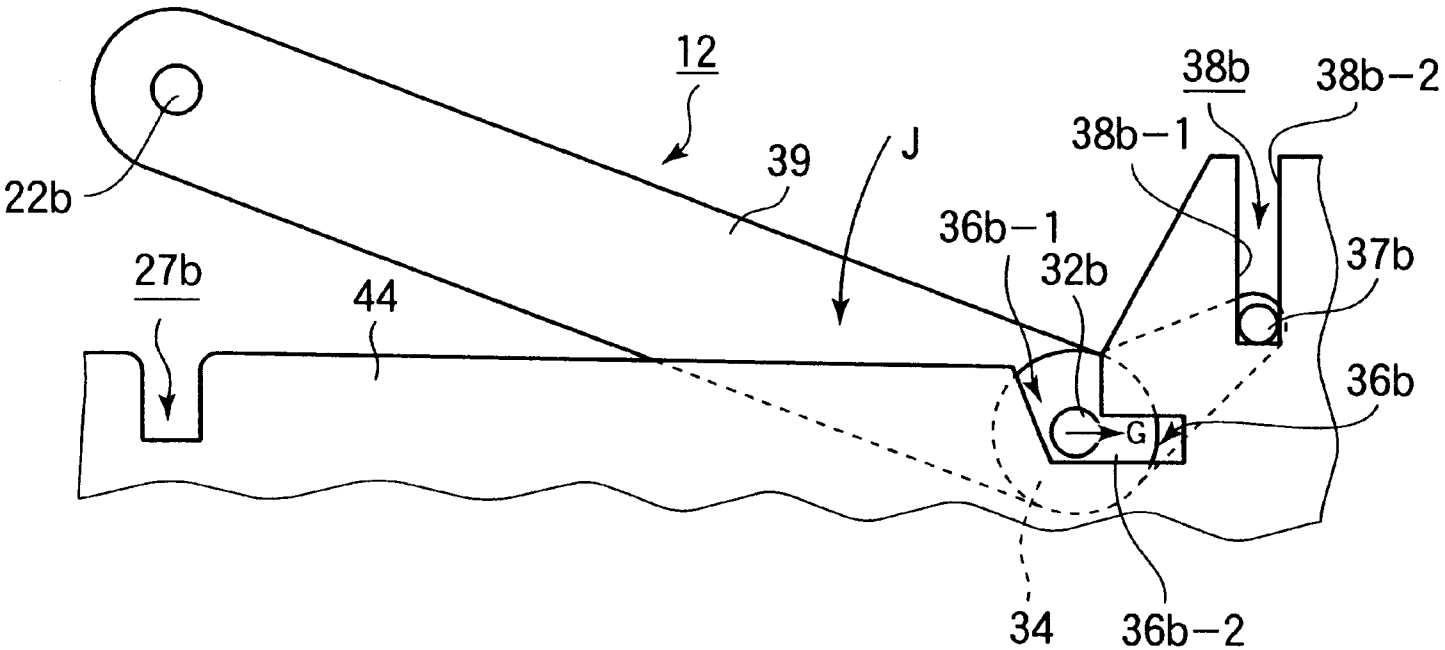
FIGS. 15 and 16 are side views of a transfer belt according to the fifth embodiment and an electrophotographic printer.
Figure 16:
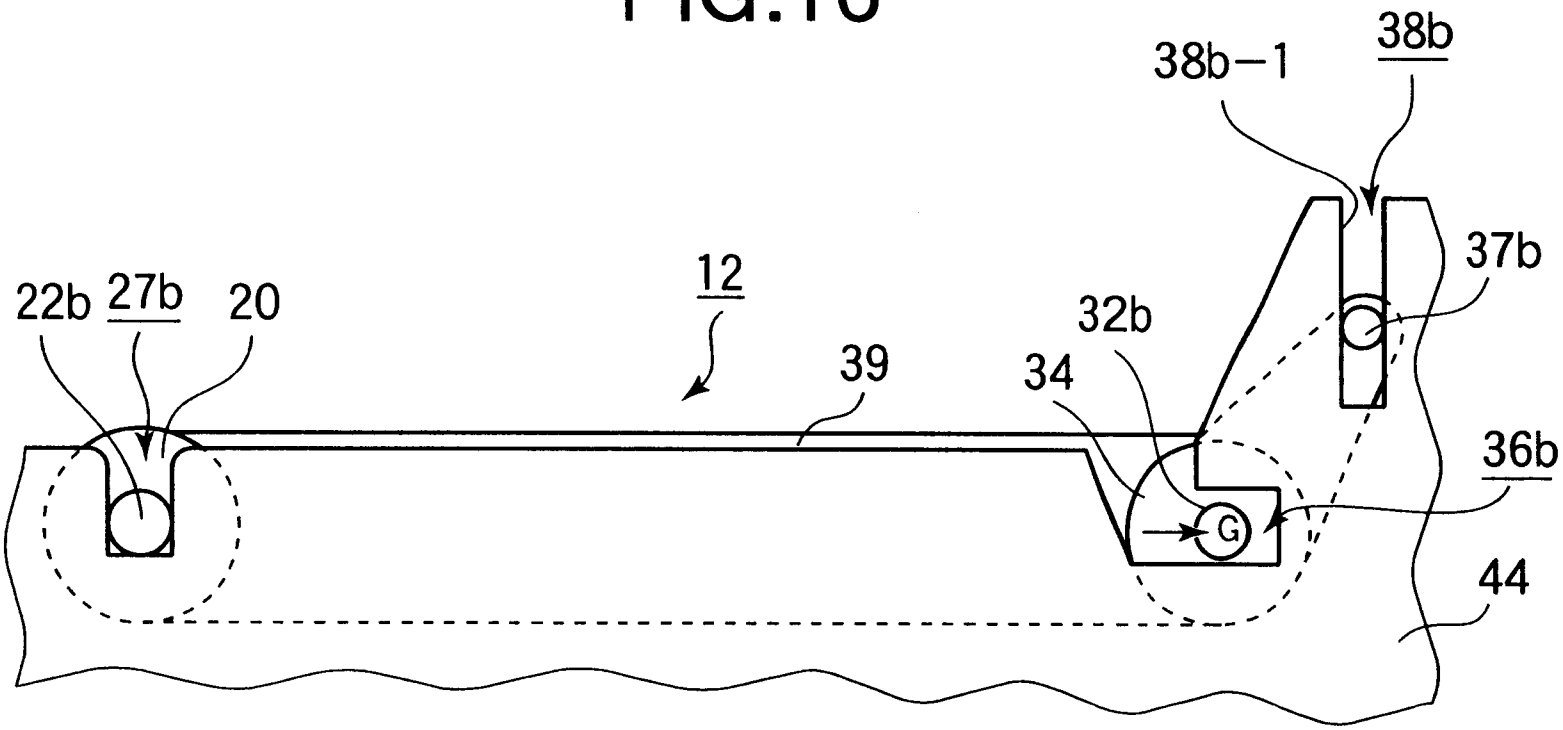

FIGS. 15 and 16 are side views of a transfer belt according to the fifth embodiment and an electrophotographic printer.

Figure 17:
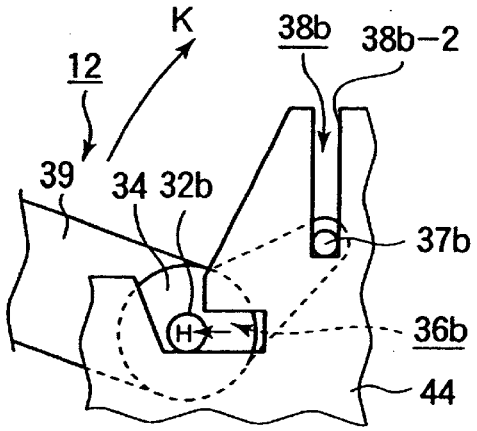
FIG. 17 is a fragmentary side view illustrating a part of the transfer belt according to the fifth embodiment and the electrophotographic printer.
Figure 18:
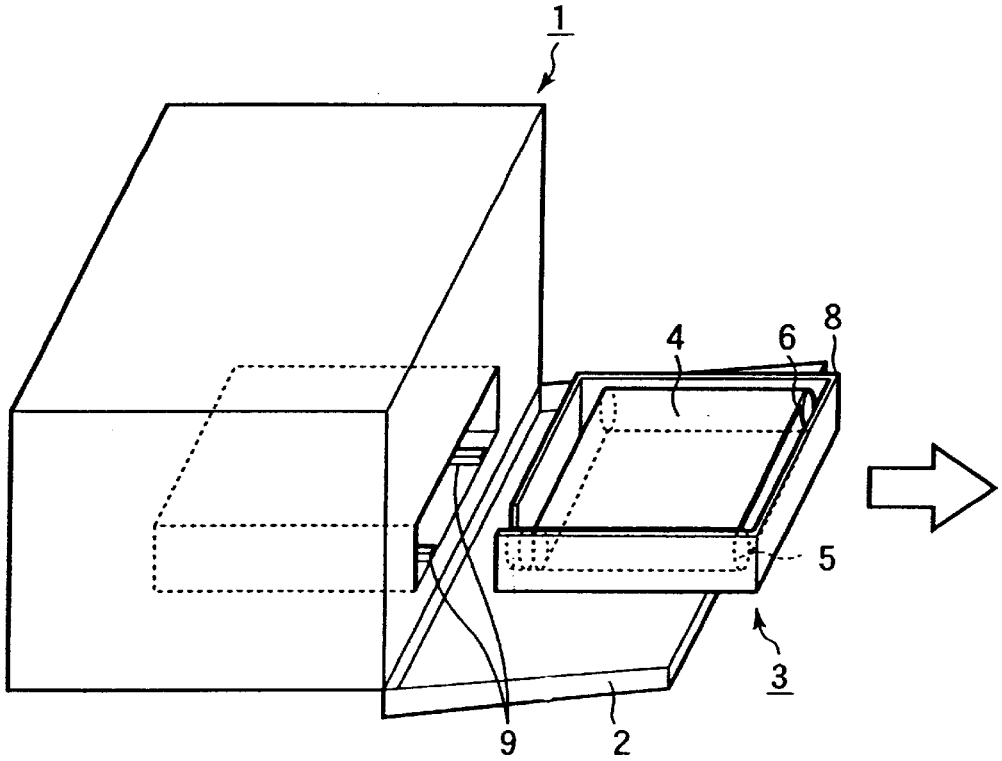
FIG.18 CONVENTIONAL ART
FIG. 18 illustrates a conventional transfer belt unit incorporated in a conventional electrophotographic printer.

FIG. 17 is a side view illustrating apart of the transfer belt according to the fifth embodiment and the electrophotographic printer.

(Attaching the Belt Unit to the Printer)

The operator holds the grip 15*c* (FIG. 1A) and then lifts the carrying handle 15. Because the free ends 15*e* and 15*d* are mounted to the right side of the center of gravity W of the belt unit 12, the belt unit 12 inclines (FIG. 8B) such that the left end or idle roller 34 is lower than the right end or bearings 22*b* and 22*b*. The belt unit 12 can be attached more easily to the printer 10 when the belt unit 12 is inclined in this manner than when the belt unit 12 is not inclined. Then, the belt unit 12 is lowered relative to the frame 44 so that the projection 37*b* enters the groove 38*b*.

When the belt unit 12 is further lowered toward the frame 44, the projection 37*b* abuts the bottom of the groove 38*b*. When the belt unit 12 is lowered still further, the belt frame 39 rotates about the projection 37*b* in a direction shown by arrow J so that the bearing 32*b* enters the opening 36*b*-1 toward the bottom of the opening 36*b*-1. When the belt unit 12 is lowered yet further, the projection 37*b* slides on a wall surface 38*b*-1 of the grooves 38*b*, while the bearing 32*b* slides in the G direction.

At this moment, the bearing 22*b* is substantially immediately over the cutout 27*b*. Thus, further lowering the belt unit 12 allows the bearing 22*b* to be smoothly received in the cutout 27*b*, so that the bearing 22*b* is normally fitted into the cutout 27*b* and the bearing 32*b* is normally fitted into the cutout 36*b*. When the belt unit 12 has been attached to the printer 10, the locking members 14*a*–14*d* of the belt unit 12 are also fitted to the locking mechanism, not shown, of the printer.

(Detaching the Belt Unit from the Printer)

The operation for detaching the belt unit 12 from the printer 10 will be described.

Just as in the first embodiment, the operator holds the grip 15*c* (FIG. 8B) and then lifts the carrying handle 15. The carrying handle 15 rotates about the free ends 15*e* and 15*d* so that there is a maximum gap between the grip 15*c* and the belt unit 12.

At this moment, the locking members 14*a*–14*d* move out of locking engagement with the locking mechanism on the printer side. When the belt unit 12 is lifted at the carrying handle 15, the bearing 22*b* moves upward out of the cutout 27*b*. Thus, the belt unit 12 will rotate about the bearing 32*b* in a direction shown by arrow K as shown in FIG. 17. Then, the projection 37*b* abuts the wall surface 38*b*-2 so that the bearing 32*b* slides laterally in a direction shown by arrow H to the bottom of the opening 36*b*-1. When the belt unit 12 is further lifted, the belt frame 39 rotates about the projection 37*b* in the K direction, and the bearing 32*b* moves out of the cutout 36*b*. When the belt unit 12 is lifted upward still further, the projection 37*b* moves out of the groove 38*b*. In this way, the belt unit 12 is detached from the printer 10.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A belt unit comprising:

at least two rollers mounted on a frame;

a belt entrained about said at least two rollers and driven to run with a medium placed on a surface thereof; and a carrying handle that is mounted to the frame to oppose the surface and extends across a width of said belt, said carrying handle being spaced apart from said belt by a gap through which the medium carried on the belt passes.

2. The belt unit according to claim 1, wherein said carrying handle is pivotally assembled to the frame.

3. The belt unit according to claim 1, wherein said carrying handle is assembled to the frame such that said carrying handle is secured to the frame at a position off a center of gravity of the belt unit.

4. A belt unit comprising:

at least two rollers mounted on a frame;

a belt entrained about said at least two rollers and driven to run with a medium placed thereon; and a carrying handle that generally extends in a direction substantially perpendicular to a direction in which said belt runs, said carrying handle being assembled to the frame, wherein when said carrying handle is left free to pivot, said carrying handle pivots toward the belt, wherein the frame has a stopper provided thereon, said stopper abutting a part of said carrying handle to prevent said carrying handle from pivoting any further when said carrying handle is left free to pivot.

5. A belt unit and an apparatus to which the belt unit is attached, the belt unit having a drive roller and an idle roller about which a belt is entrained and runs when said drive roller rotates:

wherein the belt unit includes;

a first bearing fitted to a longitudinal end of a shaft about which said drive roller rotates;

wherein the apparatus includes;

a bearing-receiving portion that receives said first bearing when the belt unit is attached to the apparatus; and a locking member that engages said first bearing to firmly hold said first bearing in position when said first bearing is received in said bearing-receiving portion.

6. The belt unit and the apparatus according to claim 5, wherein said belt unit further includes a second bearing attached to a shaft of said idle roller, wherein said apparatus further includes a frame formed with a groove that receives said second bearing when the belt unit is attached to the apparatus, the groove having a portion that extends in a direction substantially parallel to the direction in which the belt runs, and in which said first bearing is slidable.

7. A belt unit and an apparatus to which the belt unit is attached, the belt unit having a drive roller and an idle roller about which a belt is entrained and runs when said driver roller rotates:

wherein the belt unit includes a first gear attached to a shaft of said drive roller; and wherein the apparatus includes:

a shaft-receiving section formed in a frame, said shaft-receiving section receiving the shaft of said drive roller when the belt unit is attached to the apparatus; and a second gear that moves into meshing engagement with said first gear when the belt unit is attached to the apparatus, wherein the first gear and said second gear are positioned so that a line passing through a first center of said first gear and a second center of said second gear makes an angle with a line passing through the first center toward an open end of the shaft-receiving section, the angle being larger than a pressure angle between said first gear and said second gear, wherein said second gear is rotated in a direction in which said second gear exerts on said first gear a force that urges the shaft into said shaft receiving section.

8. The belt unit and the apparatus according to claim 7, wherein the frame is formed with a groove that receives a shaft of said idle roller when the belt unit is attached to the apparatus, the groove having a portion that extends in a direction substantially parallel to the direction in which the belt runs, and in which the shaft of said idle roller is slidable.

9. The belt unit and the apparatus according to claim 8, wherein the frame has an inclined surface that upwardly extends from said shaft-receiving section, wherein when the belt unit is attached to the apparatus, said inclined surface guiding the shaft of said drive roller into said shaft-receiving section.

10. The belt unit and the apparatus according to claim 8, wherein the belt unit further includes a guide projection formed on the frame on a side of said idle roller remote from said drive roller;

wherein the apparatus further includes a vertical groove formed therein that extends in a direction substantially perpendicular to the direction in which the belt runs, said vertical groove guiding said guide projection when the belt unit is attached to the apparatus.

* * * * *